US005413303A

United States Patent [19]

Lee

[11] Patent Number: 5,413,303

[45] Date of Patent: May 9, 1995

[54] SUPPORTING ASSEMBLY FOR A VEHICLE CHASSIS

[76] Inventor: Shih-Chiang Lee, 2nd Fl., No. 15, Land 249, Chang An St., Yung Kang Tsun, Lu Chou Hsiang, Taipei Hsien, Taiwan, Prov. of China

[21] Appl. No.: 168,522

[22] Filed: Dec. 16, 1993

[51] Int. Cl.[6] ..... A47F 5/00

[52] U.S. Cl. ..... 248/354.1; 72/457; 72/705

[58] Field of Search ..... 248/354.1, 352; 72/705, 72/457, 422; 280/766.1

[56] References Cited

U.S. PATENT DOCUMENTS

| | | | |
|---|---|---|---|
| 2,747,829 | 5/1956 | Schubert | 248/354.1 X |
| 4,297,068 | 10/1981 | Concha | 254/45 X |
| 4,519,236 | 5/1985 | Celette | 72/705 X |
| 4,520,649 | 6/1985 | Barton | 248/352 X |
| 4,557,127 | 12/1985 | Pietrelli | 72/705 X |
| 4,817,977 | 4/1989 | Bookbinder | 280/766.1 X |
| 5,054,307 | 10/1991 | Wisner | 72/457 |
| 5,131,257 | 7/1992 | Mingardi | 72/705 X |
| 5,186,039 | 2/1993 | Celette | 72/457 |
| 5,189,899 | 3/1993 | Hsu | 72/457 |
| 5,257,526 | 11/1993 | Teixeria | 72/705 X |

FOREIGN PATENT DOCUMENTS

| | | | |
|---|---|---|---|
| 3828838 | 3/1990 | Germany | 72/705 |
| 4109866 | 1/1992 | Germany | 72/705 |

*Primary Examiner*—J. Franklin Foss

[57] ABSTRACT

A supporting assembly for a vehicle chassis includes a base plate securely mounted to a vehicle chassis adjusting device, a rotational device mounted on the base plate and rotatable along a vertical axis, a track device including a fixed plate securely mounted on the rotational device to rotate therewith, a fixed track securely mounted on the fixed plate and extending along a horizontal direction, and a movable block slidably mounted in the fixed track, a height-adjustable device mounted on the movable block to move therewith and being adjustable in a height thereof, and a clamping device mounted on the height- adjusting device and adapted to engage with and support a vehicle chassis.

20 Claims, 8 Drawing Sheets

SUPPORTING ASSEMBLY FOR A VEHICLE CHASSIS

BACKGROUND OF THE INVENTION

1. Field of the Invention

The present invention relates to a supporting assembly which is mounted to a vehicle chassis adjusting device to support and hold the vehicle chassis to be adjusted.

2. Description of Related Art

A seriously damaged, especially twisted, vehicle chassis is generally placed on an adjusting device which is installed on the ground for repair. A number of members are used to support and hold the chassis to be adjusted by the adjusting device, such as a combination base or a lattice-like track installed on a concrete ground and in cooperation with a so-called "drag tower" as well as chains. During adjustment, the most stable fixing points locate on the supporting members. Various types of clamping devices (responsive to different types of U.S.-made, Europe-made, and Japan-made chassis) are developed to securely clamp the supporting members and the chassis together. However, another problem arises in actual practice, that is, when adjusting chassis of different sizes, the result is unsatisfactory as the deformation situations of the damaged chassis differ from one another, i.e., the adjusting orientations required for the damaged chassis vary in a large extent. Furthermore, the force applied by the drag tower to the chassis may reach several tonnes and the supporting members must have opposite supporting force for accurate adjustment of the chassis. Although both the drag tower and the combination base are adjustable to respond to the change in the adjusting orientation, the supporting members lack appropriate arrangements and thus cause problems as they are only adjustable in height and fail to provide strong structural support.

Therefore, there has been a long and unfulfilled need for an improved supporting assembly which is not only adjustable in height but also adjustable in angular position and in lateral direction so as to suit chassis of different sizes.

SUMMARY OF THE INVENTION

A supporting assembly for a vehicle chassis provided by the present invention includes a base plate mounted to a vehicle adjusting device, a rotational device mounted on the base plate and rotatable along a vertical axis, a track device includes a fixed plate securely mounted on the rotational device to rotate therewith, a fixed track securely mounted on the fixed plate and extending in a horizontal direction, and a movable block slidably mounted in the fixed track, a height-adjustable device mounted on the movable block to move therewith and being adjustable in a height thereof, and a clamping device mounted on the height adjusting device and adapted to engage with and support a vehicle chassis.

The base plate further includes a plurality of legs extending radially and outwardly from an outer periphery thereof, each leg being securely mounted to a base frame of a chassis adjusting device by a second clamping device. The second clamping device includes a substantially U-shaped stationary member which defines a space, a movable clamping plate which is restrained in the space, and a bolt having a lower end securely attached to the movable clamping plate and an upper end to which an operative handle is attached.

The rotational device includes a fixed lower member securely mounted to the base plate and an upper member rotatably mounted on the fixed lower member. The fixed lower member has a central through hole and the upper member is substantially T-shaped in section with a longitudinal portion thereof received in the central through hole. A bearing ring with an annular groove is provided between the fixed lower member and the rotatable upper member, a bearing being received in the annular groove, thereby providing a smooth rotational movement. Preferably, the lower member includes a recess in a lower end thereof, and a plate is securely attached to a lower distal end of the longitudinal portion of the rotatable upper member and is located in the recess to provide a stable rotational movement.

The fixed plate has a plurality of rings formed along a perimeter thereof through which a chain is passable for operation of a drag tower during adjustment of a vehicle chassis. The movable block of the track device includes a mount plate, at least one substantially M-shaped member securely attached to an underside of the mount plate and including two opposite limbs and a middle section therebetween, a groove being formed between each of the limbs and the middle section for engaging with the fixed track.

The middle section of the M-shaped member further comprises a first roller plate securely mounted to a bottom side thereof. The first roller plate rests on an inner bottom surface of the slot of the fixed track and includes at least one roller rotatably mounted therein to provide a smooth sliding movement between the fixed plate and the movable block.

Each of the limbs of the M-shaped member further comprises a second roller plate securely mounted to an underside thereof. The second roller plate rests on the fixed plate and includes at least one roller rotatably mounted therein to provide a smooth sliding movement between the fixed plate and the movable block.

The middle section of the M-shaped member further includes a recess in each of two opposite sides thereof which faces the associated limb, each recess having a roller rotatably mounted therein for a smooth contact with an associated inner surface of the fixed track. A third roller plate is securely mounted in each slot between the middle section and the limb and rests on the associated second roller plate and includes at least one roller rotatably mounted therein to provide a smooth sliding movement between an associated outer surface of the fixed track and the movable block.

The height-adjustable device includes an outer tube securely mounted on the movable block to move therewith, a middle tube mounted in the outer tube, and an inner tube mounted in the middle tube. The inner tube includes a plurality of vertically spaced holes in a periphery thereof. The middle tube also includes a plurality of vertically spaced holes in a periphery thereof. A positioning pin is passable through two aligned holes respectively in middle and inner tubes after a desired height of the inner tube is reached.

The inner tube further includes inner threadings in an inner periphery of an upper end thereof and an adjusting bolt is received in the upper end of the inner tube. The adjusting bolt includes a flange on an upper portion thereof which has a plurality of radial holes in a periphery thereof. The adjusting bolt further includes an annular groove in an upper end thereof, a bearing ring with a bearing therein being mounted around the upper portion of the adjusting bolt above the flange and further comprising a retainer ring mounted in the annular groove to retain the bearing ring. The first clamping device is securely mounted on the bearing ring such that the first clamping device does not rotate when the adjusting bolt is operated to change the height thereof by means of a tool passing through one of the radial holes in the periphery of the flange. A sleeve is rotatably mounted around a lower section of the outer tube and includes a ring formed in a periphery thereof. A second sleeve is rotatably mounted around an upper end of the upper tube and includes a ring formed in a periphery thereof. A chain is passable by a through the rings, said chain is used for cooperating with a drag tower for adjusting a twisted frame of a vehicle chassis.

Other objects, advantages, and novel features of the invention will become more apparent from the following detailed description when taken in conjunction with the accompanying drawings.

DESCRIPTION OF THE PREFERRED EMBODIMENT

Figure 1:
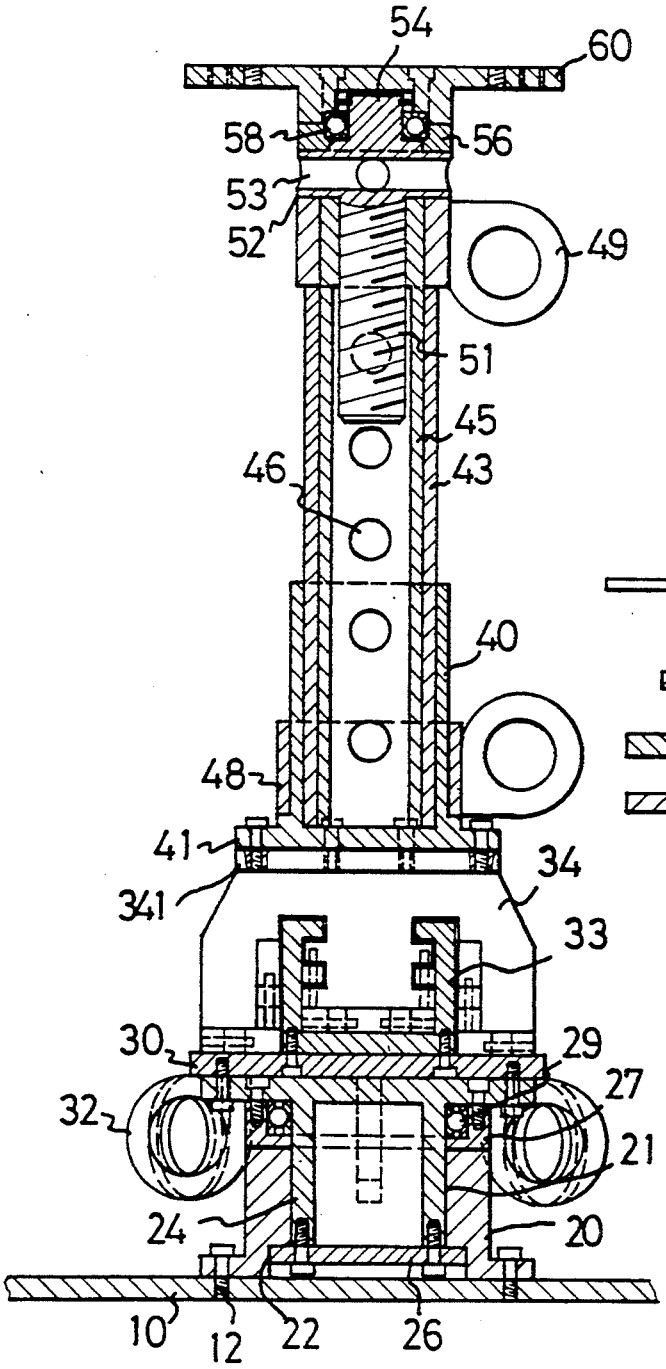
FIG. 1 is a cross-sectional view of a supporting assembly for a vehicle chassis in accordance with the present invention.

Referring to the drawings and initially to FIG. 1, a supporting assembly in accordance with the present invention generally includes a base plate 10, a rotational device, a track device, a height adjusting device, and a clamping device 60.

Figure 2:
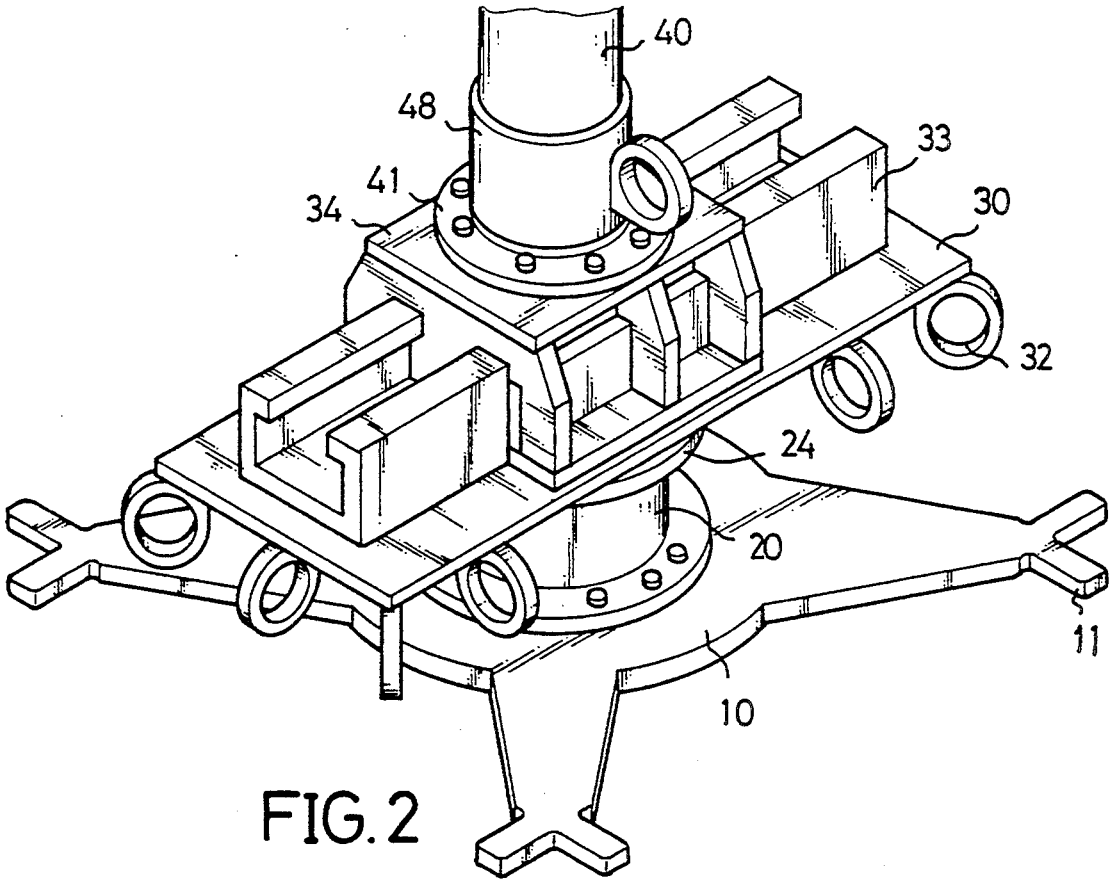
FIG. 2 is a partial perspective view showing a base plate, a rotational device, a track device, and part of a supporting device of the supporting assembly in accordance with the present invention.

Referring to FIGS. 1 and 2, the base plate 10 is a substantially circular plate with a plurality of legs 11 extending radially and outwardly from an outer periphery thereof. A plurality of holes 12 are formed in the circular plate for mounting the rotational device. Each leg 11 is fixed to a base frame of a chassis adjusting device (not shown) by means of a second clamping device. As clearly shown in FIGS. 3 and 4, the second clamping device includes a substantially U-shaped stationary member 13, a movable clamping plate 16 which is restrained in a space defined by the stationary member 13, and a bolt 14 with a lower end thereof securely attached to the movable clamping plate 16 by means of a fixing bolt 17 and with an upper end thereof attached to an operative handle 15. Operation of such a clamping device is conventional and therefore is not redundantly described herein.

Figure 5:
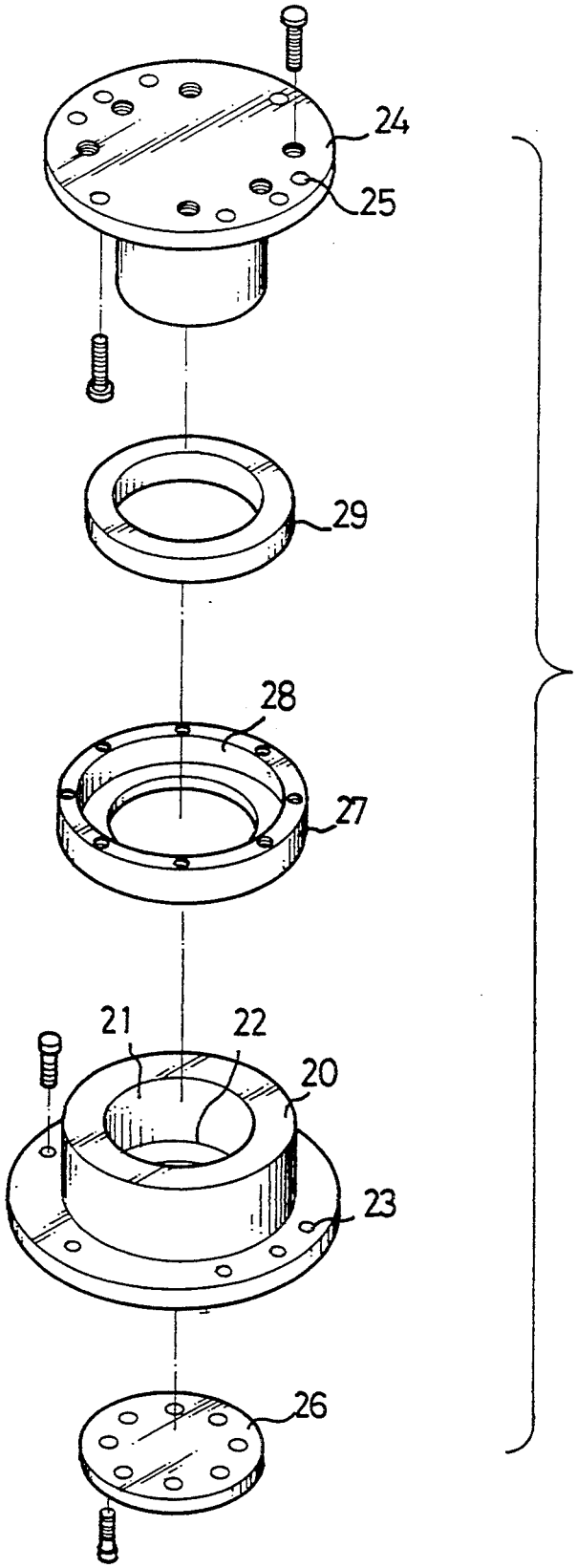
FIG. 5 is an exploded view of the rotational device of the supporting assembly in accordance with the present invention.

Referring to FIGS. 1 and 5, the rotational device includes a fixed lower member 20 with a central through hole 21 and an upper member 24 which is substantially T-shaped in section and which is rotatably mounted on the fixed lower member 20 with its longitudinal portion received in the central through hole 21. The fixed lower member 20 includes a flange with a plurality of annularly aligned holes 23 formed therein and is securely mounted to the base plate 10 by bolts passing through holes 23 in the flange and corresponding holes 12 in the base plate 10. Preferably, between the fixed lower member 20 and the rotatable upper member 24, a bearing ring 27 with an annular groove 28 therein is provided for receiving a bearing 29 in the annular groove 28, thereby providing a smooth rotational movement therebetween. Preferably, the lower member 20 includes a recess 22 in a lower end thereof, and a plate 26 is located in the recess 22 and is secured to the lower distal end of the longitudinal portion of the rotatable upper member 24, thereby providing a stable rotational movement, as clearly shown in FIG. 1.

Figure 6:
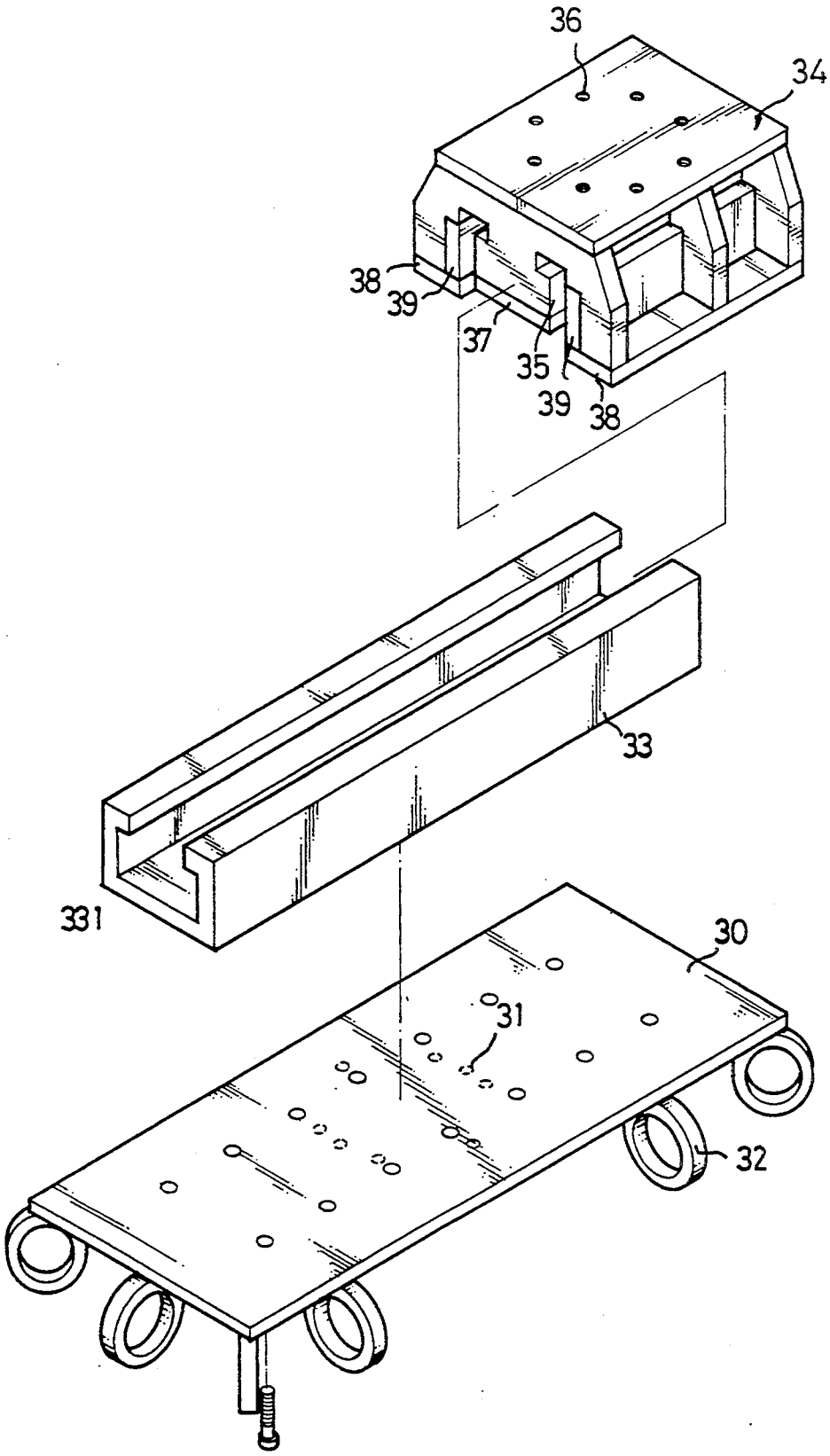
FIG. 6 is an exploded view illustrating the track device.

Referring to FIGS. 1, 2, and 6, the track device includes a fixed plate 30 with a plurality of holes 31 therein by means of which the fixed plate 30 is securely mounted on the upper rotatable member 24 to rotate therewith. A plurality of spaced rings 32 are formed along a perimeter of the fixed plate 30 through which a chain (not shown) is passable for operation of a drag tower during adjustment of a vehicle chassis. A fixed track 33 is securely mounted to the fixed plate 30 and has a slot 331 which extends along a horizontal direction and which is substantially of an inverted T-shape cross section. The track device further includes a movable block 34 which includes a middle section 35 correspondingly formed to the T-shaped slot 331 and is therefore movable along the longitudinal direction of the fixed track 33.

Figure 7:
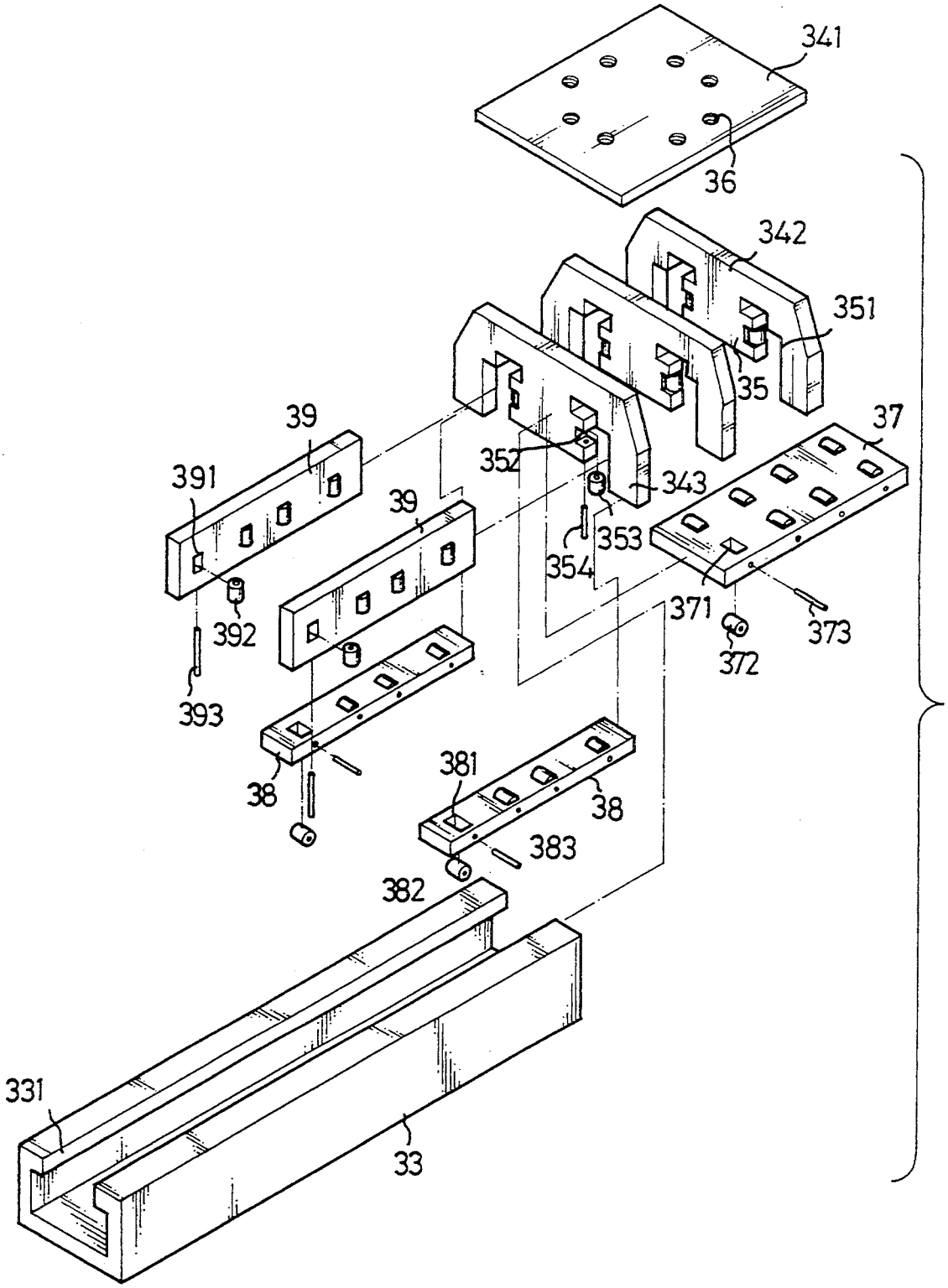
FIG. 7 is another exploded view which illustrates the details of the movable block of the track device.
Figure 8:
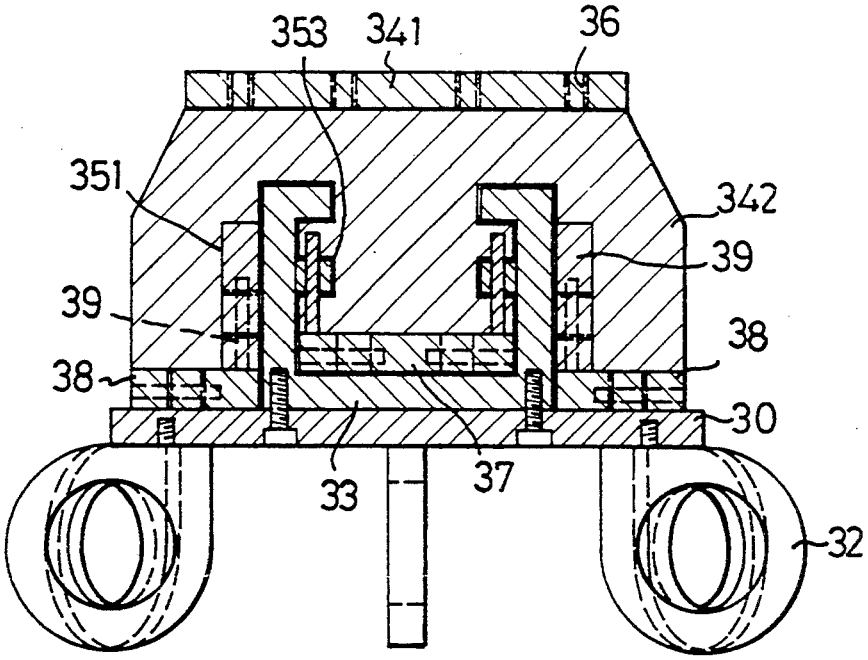
FIG. 8 is a cross-sectional view of the track device.

Referring to FIGS. 1 and 6 through 8, the movable block 34 includes a mount plate 341 with a plurality of holes 36 therein for mounting the height adjusting device, a plurality of substantially M-shaped members 342 securely attached to an underside of the mount plate 341 and each including two limbs 343 and an above-mentioned section 35, a slot 351 is defined between each of the limbs 343 and the section 35 for engaging with the fixed track 33. As shown in FIGS. 6 through 8, a first roller plate 37 is securely mounted to bottom sides of said sections 35 of the M-shaped members 342 and rests on an inner bottom surface of the slot 331 of the fixed track 33 and includes a plurality rows of rectangular holes 371 each having a roller 372 rotatably mounted therein by a pin 373, providing a smooth sliding movement between the fixed plate 30 and the movable block 34. A second roller plate 38 is securely mounted to an underside of each limb 343 of the M-shaped member 342 and rests on the fixed plate 30 and is adjacent to the fixed track 33, each second roller plate 38 includes a row of rectangular holes 381 each having a roller 382 rotatably mounted therein by a pin 383, providing a smooth sliding movement between the fixed plate 30 and the movable block 34.

As shown in FIG. 7, the middle section 35 of each M-shaped member 342 further includes a recess 352 in each of two opposite sides thereof which faces an associated limb 343, the recess 352 having a roller 353 rotatably mounted therein by a pin 354 for a smooth contact with an associated inner surface of the fixed track 30. As shown in FIG. 8, a third roller plate 39 is securely mounted in each slot 351 (the slot 351 is sufficiently large to accommodate one side wall of the track and the third roller plate 39) and rests on an associated second roller plate 38 and is adjacent to associated lateral side of fixed track 33. Each third roller plate 39 includes a row of rectangular holes 391 each having a roller 392 rotatably mounted therein by a pin 393, providing a smooth contact between the outer surfaces of the side walls of fixed track 33 and associated side walls of the limbs 343 of the M-shaped members 342 thereby providing a smooth sliding movement therebetween.

Figure 9:
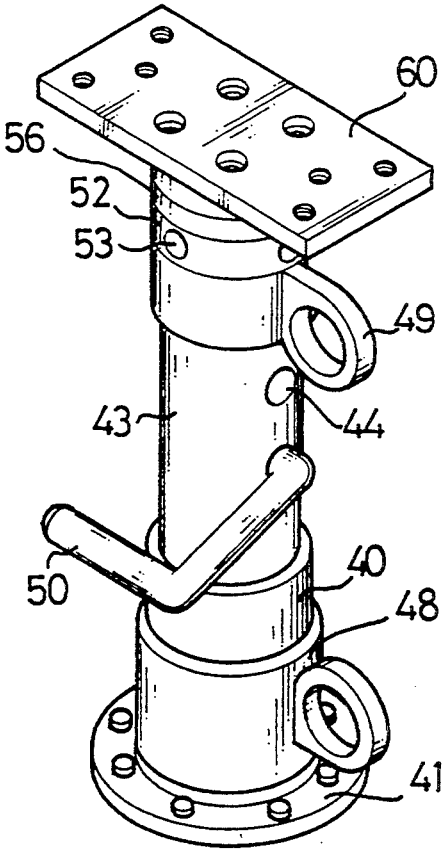
FIG. 9 is a perspective view of a height adjusting device and a clamping device of the supporting assembly in accordance with the present invention.
Figure 10:
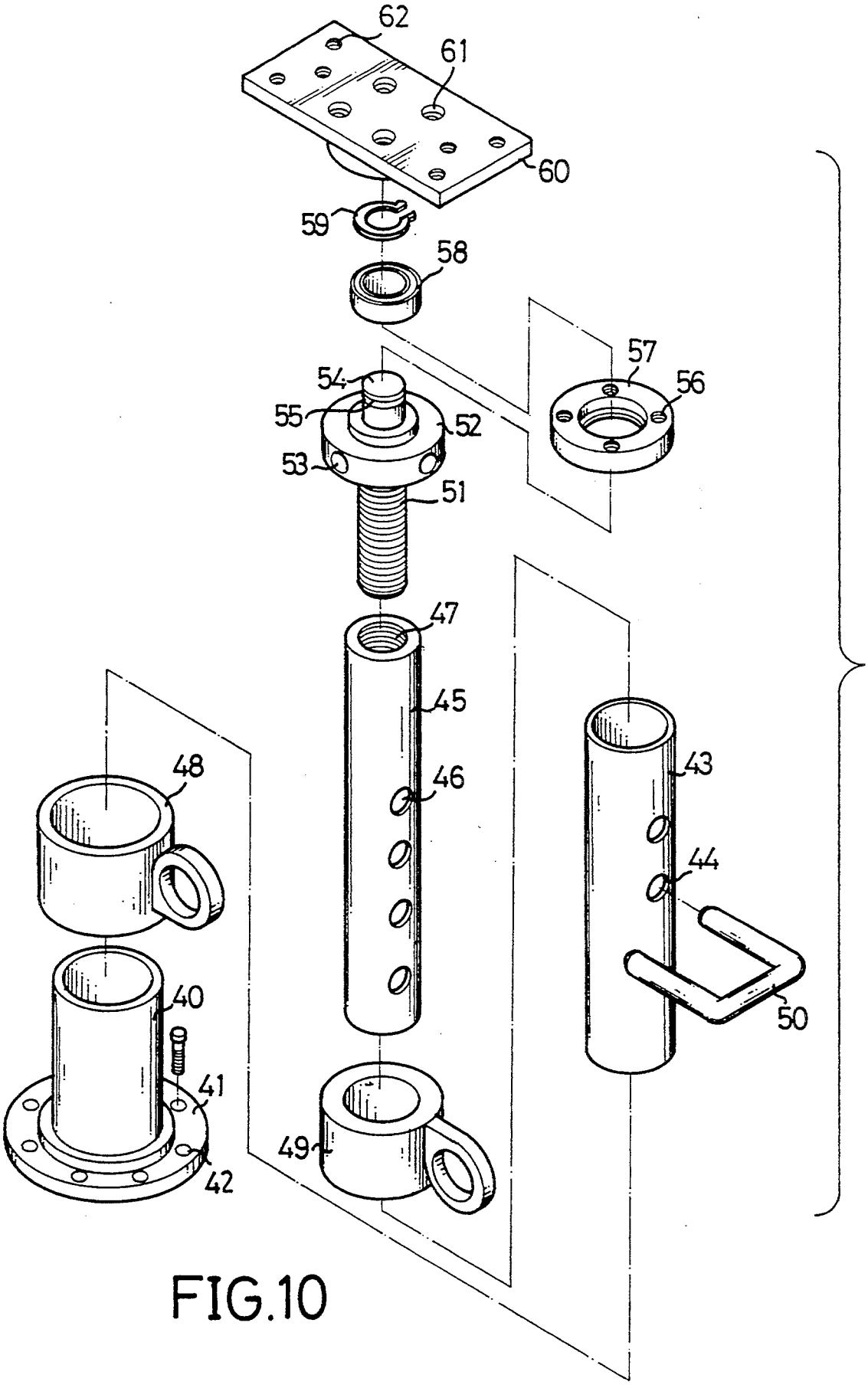
FIG. 10 is an exploded view of the height adjusting device and the clamping device in FIG. 9.

Referring to FIGS. 1, 9, and 10, mounted on the mount plate 341 of the track device is a height adjustable device which includes an outer tube 40, a middle tube 43 mounted in the outer tube 40, and an inner tube 45 mounted in the middle tube 43. The outer tube 40 includes a flange 41 on a lower end thereof which has a plurality of holes 42 therein whereby the outer tube 40 is mounted on the mount plate 341 by bolts passing through holes 42 and holes 36 in the mount plate 341. A sleeve 48 is rotatably mounted around a lower section of the outer tube 40 and includes a ring (not labeled) formed in a periphery thereof through which a chain (not shown) is passable so as to be operated by a drag tower during adjustment of a vehicle chassis.

The inner tube 45 includes a plurality of vertically spaced holes 46 in a periphery thereof. The middle tube 43 also includes a plurality of vertically spaced holes 44 in a periphery thereof, and a positioning pin 50 is provided to pass through two aligned holes 44 and 46 respectively in middle and inner tubes 43 and 45 after a desired height of the inner tube 45 is reached, i.e., the height of the inner tube 45 is adjustable by pulling it upwardly and then positioning it by means of the positioning pin 50.

The inner tube 45 further includes inner threadings in an inner periphery of an upper end thereof and an adjusting bolt 51 is received in the upper end of the inner tube 45 for micro-adjustment of the height of the previously-mentioned clamping device 60 which will be explained hereinafter. The adjusting bolt 51 includes a flange 52 on an upper portion thereof which has a plurality of radial holes 53 in a periphery thereof. The adjusting bolt 51 further includes an annular groove 55 in an upper end 54 thereof. A bearing ring 57 with a bearing 58 therein is mounted around the upper portion of the adjusting bolt 51 above the flange 52 and is retained in position by means of a retainer ring 59 mounted in the annular groove 55. A second sleeve 49 is rotatably mounted around the upper end of the inner tube 45 and includes a ring (not labeled) formed in a periphery thereof through which a chain (not shown) is passable so as to be operated by a drag tower during adjustment of a vehicle chassis.

The first clamping device 60 is securely mounted on the bearing ring 57 by means of passing bolts through holes 61 therein and corresponding holes 56 in the bearing ring 57. The height of the first clamping device 60 is primarily determined by the inner tube 45 and is micro-adjustable by the adjusting bolt 51 by passing a suitable tool through one of the holes 53 to rotate the adjusting bolt 51, thereby raising or lowering the first clamping device 60. The first clamping device 60 in this embodiment is chosen to mate with a vehicle chassis of the type having screw holes therein. It is appreciated that the first clamping device 60 can be replaced by other types of clamping devices so as to mate with different vehicle chassis.

Figure 4:
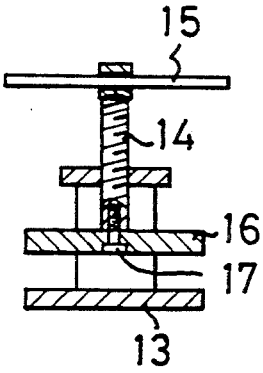
FIG. 4 is a cross-sectional view of the clamping device in FIG. 3.
Figure 3:
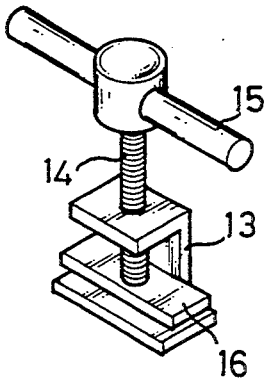
FIG. 3 is a perspective view of a clamping device for fixing the base plate of the supporting assembly to a vehicle chassis adjusting device.

In operation, the base plate 10 is secured to a chassis adjusting device by the second clamping devices shown in FIGS. 3 and 4 or other suitable clamping devices. Then, the rotatable member 24 of the rotational device is rotated to a desired orientation for adjustment. Thereafter, the movable block 34 is moved to a position where the first clamping device 60 is below the vehicle chassis to be adjusted. The inner tube 45 is raised to a height close to the vehicle chassis and the first clamping device 60 is adjusted to the desired height under operation of the adjusting bolt 51 and is then secured to the vehicle chassis by bolts. The vehicle chassis is thus stably supported by a plurality of supporting assemblies. Thereafter, the sleeves 48 and 49 are rotated to a desired orientation such that chains may be passed through for operation during adjustment of the vehicle chassis under operation of a drag tower or other suitable means for stretching the twisted frame of the vehicle chassis. Since the twisted frame may be stretched in various orientations in order to completely reshape the structure, positions and orientations of the supporting assembly must be adjustable responsive to the change in the point of the force applied by the drag tower, so as to obtain accurate adjustment effect in the chassis, and such object is satisfactorily achieved under the provision of the supporting assembly of the present invention.

Although the invention has been explained in relation to its preferred embodiment, it is to be understood that many other possible modifications and variations can be made without departing from the spirit and scope of the invention as hereinafter claimed.

I claim:

1. A supporting assembly for a vehicle chassis, comprising:

a base plate (10) adapted to be securely mounted to a vehicle chassis adjusting device;

a rotational device mounted on the base plate (10) and rotatable along a vertical axis;

a track device including a fixed plate (30) securely mounted on the rotational device to rotate therewith, a fixed track (33) securely mounted on the fixed plate and extending in a horizontal direction, and a movable block (34) slidably mounted in the fixed track;

a height-adjustable device mounted on the movable block to move therewith and being adjustable in a height thereof; and a clamping device (60) mounted on the height adjusting device and adapted to engage with and support a vehicle chassis to be adjusted.

2. The supporting assembly as claimed in claim 1 wherein:

the base plate (10) further includes a plurality of legs (11) extending radially and outwardly from an outer periphery thereof.

3. The supporting assembly as claimed in claim 2 further comprising a second clamping device for mounting each of the legs (11) to a base frame of a chassis adjusting device.

4. The supporting assembly as claimed in claim 3 wherein:

the second clamping device includes a substantially U-shaped stationary member (13) which defines a space, a movable clamping plate (16) which is restrained in the space, and a bolt (14) having a lower end securely attached to the movable clamping plate (16) and an upper end, an operative handle (15) being attached to the upper end of the bolt (14).

5. The supporting assembly as claimed in claim 1 wherein:

the rotational device includes a fixed lower member (20) securely mounted to the base plate (10) and an upper member rotatably mounted on the fixed lower member (20).

6. The supporting assembly as claimed in claim 5 wherein:

the fixed lower member (20) has a central through hole (21) and the upper member (24) is substantially T-shaped in section with a longitudinal portion thereof received in the central through hole (21).

7. The supporting assembly as claimed in claim 6 further comprising a bearing ring (27) with an annular groove (28) provided between the fixed lower member (20) and the rotatable upper member (24), a bearing (29) being received in the annular groove (28), thereby providing a smooth rotational movement.

8. The supporting assembly as claimed in claim 7 wherein:

the lower member (20) includes a recess (22) in a lower end thereof, and the longitudinal portion of the rotatable upper member (24) includes a plate (26) securely attached to a lower distal end thereof, the plate (26) is located in the recess (22).

9. The supporting assembly as claimed in claim 1 wherein the fixed plate (30) includes a plurality of spaced rings (32) formed along a perimeter thereof.

10. The supporting assembly as claimed in claim 1 wherein:

the movable block (34) includes a mount plate (341) with an underside, at least one substantially M-shaped member (342) securely attached to the underside of the mount plate (341) and two opposite limbs (343) and a middle section (35) therebetween, a slot (351) being formed between each of the limbs (343) and the middle section (35) for engaging with the fixed track (33).

11. The supporting assembly as claimed in claim 10 wherein:

the middle section (35) of the M-shaped member (342) further comprises a first roller plate (37) securely mounted to a bottom side thereof, the first roller plate (37) rests on an inner bottom surface of the fixed track (33) and includes at least one roller (372) rotatably mounted therein to provide a smooth sliding movement between the fixed plate (30) and the movable block (34).

12. The supporting assembly as claimed in claim 10 wherein:

each of the limbs (343) of the M-shaped member (342) further comprises a second roller plate (38) securely mounted to an underside thereof, the second roller plate (38) rests on the fixed plate (30) and includes at least one roller (382) rotatably mounted therein to provide a smooth sliding movement between the fixed plate (30) and the movable block (34).

13. The supporting assembly as claimed in claim 10 wherein:

the middle section (35) of the M-shaped member (342) further includes a recess (352) in each of two opposite sides thereof which faces the associated limb (343), the recess (352) has a roller (353) rotatably mounted therein, a third roller plate (39) is securely mounted in each slot (351) and rests on the associated second roller plate (38) and includes at least one roller (392) rotatably mounted therein, thereby providing a smooth sliding movement between the fixed track (33) and the movable block (34).

14. The supporting assembly as claimed in claim 1 wherein:

the height adjustable device includes an outer tube (40) securely mounted on the movable block (34) to move therewith, a middle tube (43) mounted in the outer tube (40), and an inner tube (45) mounted in the middle tube (43), the inner tube (45) includes a plurality of vertically spaced holes (46) in a periphery thereof, the middle tube (43) also includes a plurality of vertically spaced holes (44) in a periphery thereof, and further comprising a positioning pin (50) which is passable through two aligned holes (44 and 46) respectively in middle and inner tubes (43 and 45) after a desired height of the inner tube (45) is reached.

15. The supporting assembly as claimed in claim 14 wherein:

the inner tube (45) further includes inner threadings in an inner periphery of an upper end thereof, a threaded adjusting bolt (51) is received in the upper end of the inner tube (45), and the first clamping device (60) is mounted on the adjustable bolt (51).

16. The supporting assembly as claimed in claim 15 wherein:

the adjusting bolt (51) includes a flange (52) on an upper portion thereof which has a plurality of radial holes (53) in a periphery thereof through which a tool is passable to rotate the adjusting bolt (51), thereby changing a height of the first clamping device (60).

17. The supporting assembly as claimed in claim 16 wherein:

the adjusting bolt (51) further includes an annular groove (55) in an upper end (54) thereof, a bearing ring (57) with a bearing (58) therein is mounted around the upper portion of the adjusting bolt (51) above the flange (52) and further comprising a retainer ring (59) mounted in the annular groove (55) to retain the bearing ring (57).

18. The supporting assembly as claimed in claim 17 wherein:

the first clamping device (60) is securely mounted on the bearing ring (57) such that the first clamping device (60) does not rotate when the adjusting bolt (51) is operated to change the height thereof.

19. The supporting assembly as claimed in claim 14 wherein:

the outer tube (40) further includes a sleeve (48) rotatably mounted around a lower section thereof, the sleeve (48) includes a ring formed in a periphery thereof.

20. The supporting assembly as claimed in claim 18 wherein:

the inner tube (45) further includes a sleeve (49) rotatably mounted around an upper end thereof, the sleeve (49) includes a ring formed in a periphery thereof.

* * * * *